United States Patent [19]

Knight

[11] Patent Number: 4,528,916

[45] Date of Patent: Jul. 16, 1985

[54] PLURAL BOX CONSTRUCTION

[75] Inventor: Lloyd F. Knight, Clearwater, Fla.

[73] Assignee: Safe Deposit Box Construction, Clearwater, Fla.

[21] Appl. No.: 486,246

[22] Filed: Apr. 18, 1983

[51] Int. Cl.[3] ..... E05G 1/06

[52] U.S. Cl. ..... 109/56; 312/199; 109/67; 49/168

[58] Field of Search ..... 232/4 R, 6, 24, 25, 232/26; 109/53, 56, 66, 67, 75; 312/109, 199; 49/91, 95, 163, 168, 371, 483

[56] References Cited

U.S. PATENT DOCUMENTS

| | | | |
|---|---|---|---|
| 712,139 | 10/1902 | Johnson | 49/168 X |
| 1,623,652 | 4/1927 | Bang | 49/168 |
| 3,690,038 | 9/1972 | Dieterich | 49/489 |
| 3,871,283 | 3/1975 | John | 109/56 |
| 4,114,319 | 9/1978 | Governale | 49/488 |
| 4,194,453 | 3/1980 | Cutter | 109/56 |

*Primary Examiner*—Robert P. Swiatek
*Attorney, Agent, or Firm*—Frijouf, Rust & Pyle

[57] ABSTRACT

A deposit box construction is disclosed wherein vertically adjacent deposit boxes are interlocked in any combination to provide a deposit box installation having any desired mix of box sizes. In the preferred embodiment, each box door is grooved to receive a metallic strip member that is slidably disposed within juxtaposed grooves so that vertically adjacent doors are rigidly interconnected by the strip members. The interlocking means further includes a flat, preferably metallic plate member that is fixedly secured at longitudinally opposed ends of the adjacent doors. Thus, one strip member and one plate member interlock two vertically adjacent door members to provide a single deposit box of twice the capacity of a single box. A larger number of vertically adjacent doors may be similarly interlocked by n−1 pairs of strip members and plate members.

11 Claims, 15 Drawing Figures

PLURAL BOX CONSTRUCTION

BACKGROUND OF THE INVENTION

1. Field of the Invention.

This invention relates, generally, to deposit box constructions, and more specifically relates to a construction that provides flexibility in the pattern of boxes available at a deposit box site.

2. Description of the Prior Art.

In a conventional safe deposit box construction, a plurality of individual safe deposit boxes are provided in a monolithic construction. Thus, each individual box in the monolithic construction is integrally formed with all of the other boxes in the construction. Once a given pattern of large, medium and small size boxes has been constructed, the institution owning the installation cannot change the pattern. For example, in a typical installation, a bank or other institution maintaining a vault for customers might order a safe deposit box construction having a large number of small size boxes, a lesser number of medium size boxes, and a smaller number of large size boxes. A great deal of planning is required by an institution so that a construction having a favorable mix of box sizes will be ordered. Unfortunately, it is virtually impossible for any institution maintaining a vault to accurately predict the optimal mix of box sizes that should be maintained in the institution. Accordingly, many boxes often go unrented or are rented at an economical disadvantage because the boxes are too small or too large for the mix of customers of the institution.

Due to the high expense of safe deposit box installation, whenever any mix of box sizes results in unrented or unprofitably rented boxes, the financial losses are considerable.

There is clearly a need for a safe deposit box construction that is not of monolithic construction. Specifically, institutions maintaining a vault should be able to change the combination, or mixture, of box sizes within the safe deposit box installation. Thus, a plurality of smaller boxes could be converted into a single box of larger volume, when needed, and of course, larger boxes could be broken down into a plurality of smaller boxes when needed.

Although such a flexible safe deposit box construction is highly desirable, such a construction does not appear in the prior art.

SUMMARY OF THE INVENTION

The longstanding but heretofore unfulfilled need for a flexible deposit box construction is now provided in the form of an installation that has the outward appearance of a conventional, monolithic deposit box construction.

However, the outward appearance of the inventive construction differs from a typical, conventional installation in that all of the individual boxes appear to be that which would be considered the smaller boxes in a conventional installation. As stated hereinabove, a conventional installation normally has differing sizes of individual boxes, whereas the inventive installation will appear to have only one size of boxes, However, the inventive installation is provided with ganging means whereby adjacent boxes are interlocked. Accordingly, upon a casual inspection all of the boxes appear as small boxes, the novel installation actually includes a mix of large, medium size, and small boxes in any desired combination. More importantly, the mix that is presented may be changed at any time, with very little effort.

An elongate strip member is employed to interlock vertically adjacent deposit box doors with the strip member being provided with a specific construction that prevents unauthorized retraction. More specifically, the strip member has opposed longitudinal edges slidably received within complementary grooves formed in vertically adjacent boxes.

A plate member is also employed to interlock adjacent boxes, although, theoretically, the elongate strip member is all that is needed to accomplish the interlocking. The plate member, which is preferably vertically aligned and disposed so that the central portion, thereof straddles the elongate strip member, is employed primarily to impart rigidity to the ganged box doors.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
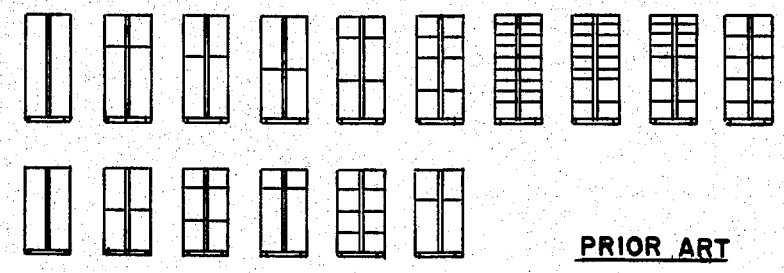
FIG. 1 represents the prior art in safe deposit box construction.

FIG. 1 represents the prior art in safe deposit box construction. FIG. 1 illustrates a composite, diagrammatic view showing a plurality of conventional safe deposit box installations demonstrating how different patterns, or mixtures of large, medium and small size boxes are typically arranged in monolithic constructions in the prior art.

Figure 2:
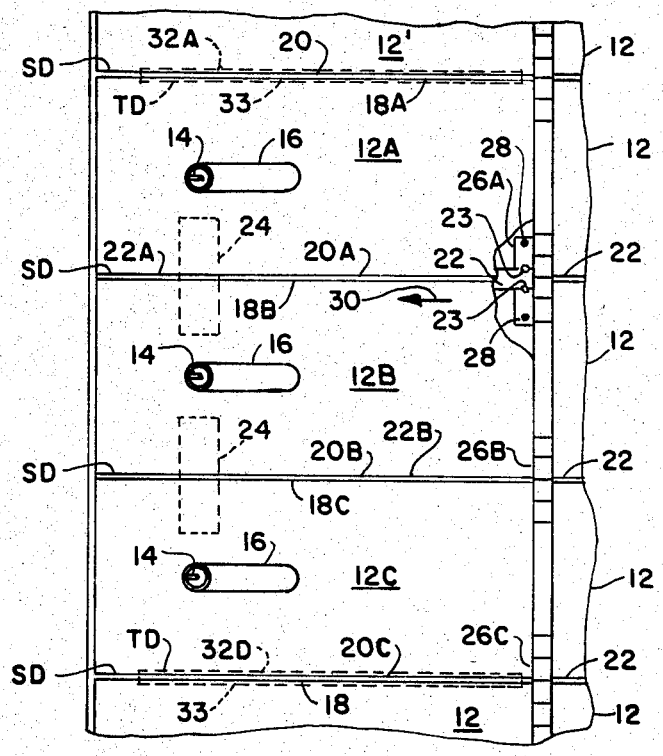
FIG. 2 is a front elevational view of the preferred embodimehnt of the invention.

Referring now to FIG. 2, it will there be seen that a preferred embodiment of the inventive assembly is generally indicated by the reference numeral 10.

FIG. 2 shows a plurality of containers shown as vertically adjacent safe deposit box door members, collectively designated 12. As is clear from the drawing, such doors 12 are horizontally adjacent to at least one other column of vertically adjacent door members. Thus, when viewed as a whole, the inventive installation appears to provide a construction comprising a plurality of vertically stacked deposit boxes in laterally disposed relation to columns of boxes appearing to have the same dimensions.

Each door 12 is provided with locking means shown as conventional keyed entry means, collectively designated 14, and a conventional name plate means 16, adjacent thereto.

Each door 12 is preferably of metallic construction and has a first or an upper longitudinal edge 18 and a transversely spaced, second or lower longitudinal edge 20. A groove 21 is formed in each longitudinal edge 18, 20, i.e., such edges are kerfed. An elongate interlocking means, preferably a metallic strip member 22 is slidably disposed within the elongate cavity collectively defined by vertically adjacent ones of such grooves, to interlock vertically adjacent doors 12.

Since the doors 12 are slightly vertically spaced apart, as is clear from FIG. 2, the presence of the strip member 22 therebetween is visually ascertainable.

A plate-like ganging member 24 is employed to further interlock vertically adjacent doors, as is also shown in FIG. 2. As indicated by the use of phantom lines, the ganging members 24 is disposed on the interior surface of the door 12, and are preferably disposed to straddle the strip member 22. In the preferred embodiment, the ganging memberts 24 are disposed in substantial vertical disposition, and are also vertically aligned with the keyed entry means 14. Thus, the rigidity between vertically adjacent doors supplied by ganging member 24 enables ganged doors 12 to have the feel of a single door when the same is opened and closed.

It is important to note that the first, second and third doors 12A, 12B and 12C shown in FIG. 2 are mounted for pivotal movement in a horizontal plane by first, second and third hinge members 26A, 26B and 26C having a pivotal axes along a common line. The hinge members 26 are essentially of conventional construction, and include a plurality of four hinge fasteners (mounting screws), collectively designated 28. The first, second and third doors 12A, 12B and 12C respectively include first and second edges respectively, 18A, 20A; 18B, 20B; 18C and 20C. A first, second, third and fourth partition of which 32A and 32D are shown in FIG. 2 are removably disposed between vertically adjacent doors 12. The distal end of each strip member 22 includes a cut out or notch 23 to provide a cut-away portion through which the innermost ones of hinge fasteners 28 extend when the doors 12 are properly hingedly mounted. Thus, as is clear from an inspection of FIG. 2, the presence of the innermost hinge fasteners 28 within such notches or cutaway portions will prevent the retraction of the strip member 22 responsive to external forces imparted in the direction indicated by the single headed arrow appearing in FIG. 2, and designated 30. However, when authorized personnel desire to change the mix of deposit boxes in the inventive installation, removal of the innermost hinge fasteners 28 can be readily accomplished to permit longitudinal retraction or insertion of the strip member 22, after which the hinge fasteners 28 may be reinstalled. In the example shown in FIG. 2, three vertically adjacent doors 12A, 12B and 12C have been ganged to provide a single door. It will be observed that a first and second elongated interlocking means 22A and 22B and two ganging members 24 are needed to accomplish this particular pattern of interlocking doors. In this particular example, a fourth partition or shelf member 32D, shown in phantom lines, is disposed at the bottom of the single box that has been formed from the three individual boxes. The top of such box is also closed by a first partition or shelf member 32A that of course provides the bottom shelf for the next vertically upwardly adjacent box member. However, due to the inventive construction to be described hereinafter, a plurality of partitions or shelf means 32 could be inserted in the large box by adding shelves thereto. For example, if a second and third shelf 32B and 32C respectively are added to the configuration adjacent edges 28A, 18B and 20B, 18C respectively shown in FIG. 2, the opening of the three ganged doors 12 would reveal a safe deposit box subdivided into three equal portions or a first, second and third container. Both or one of such shelves could be removed by authorized personnel to provide a single large box having no shelves, one shelf, or two shelves. However, once the shelves 32 are installed, such shelf 32 may not be retracted by unauthorized personnel because the hinge members 26 (and/or the door 12 above or the door 12 below the ganged door) will bar such unauthorized retraction thereof.

Figure 3:
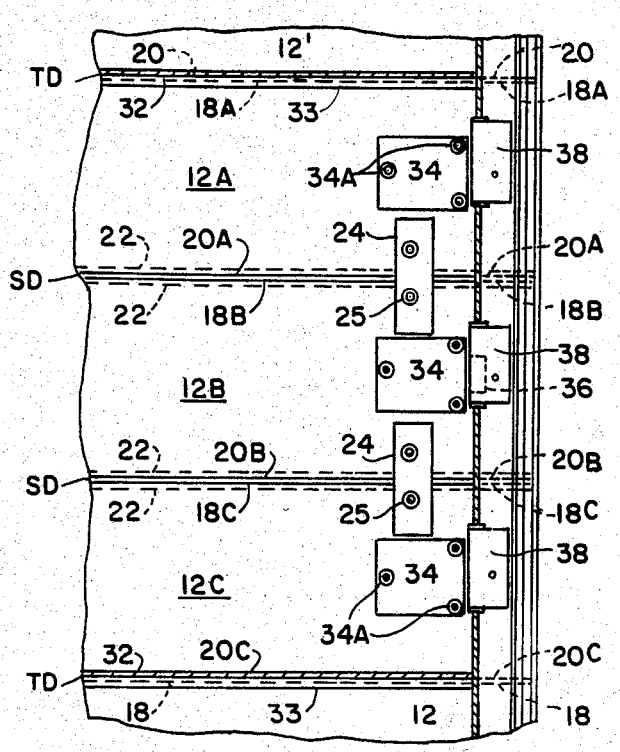
FIG. 3 is a rear elevational view of the preferred embodiment as seen from inside the boxes.

Referring now to FIG. 3, it will there be seen that the ganging members 24 are fixedly secured to vertically adjacent doors 12A, 12B and 12C by suitable, conventional means designated 25. It should be understood that FIG. 3 is an interior view of the doors 12, whereas FIG. 2 was an exterior view.

Accordingly, the lock mechanism employed in the novel structure is visible in FIG. 3. Specifically, a lock housing 34 is provided interiorly of each door 12, and is fixedly secured thereto adjacent its proximal end by suitable securing means 34A. In conventional installations, each lock housing 34 will house a locking bar and associated parts of a conventional locking means. However, in the inventive construction, where three vertically adjacent doors have been interlocked as shown in FIG. 3, each outermost lock housing 34 may be "gutted" i.e., such outermost housings 34 may be emptied of their operative parts. The central lock housing 34, in this particular embodiment, is maintained in its normal, operative disposition. As such, the central lock housing 34 is provided with a locking bar 36 that extends outwardly of the lock housing 34 when the door is locked. When in its extended configuration, locking bar 36 is housed within its associated housing 38, as is shown in FIG. 3. Thus, retraction of locking bar 36 from a housing 38 and into its housing 34 will permit opening the door, as is of course well known. Although locking bar 36 does not appear in the outermost housings 34, the locking bar housings 38 are best left in an operative position so that it is a simple matter to re-install locking mechanisms when it is desired to change the mix of boxes.

Figure 4:
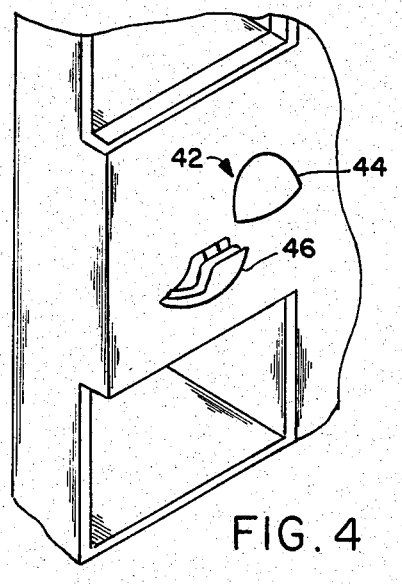
FIG. 4 is a perspective view showing bracket means that support the shelf means of the invention.
Figure 4A:
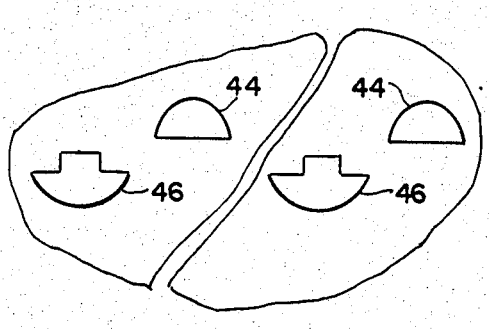
FIG. 4A is an elevational view of the bracket means of FIG. 4.
Figure 5:
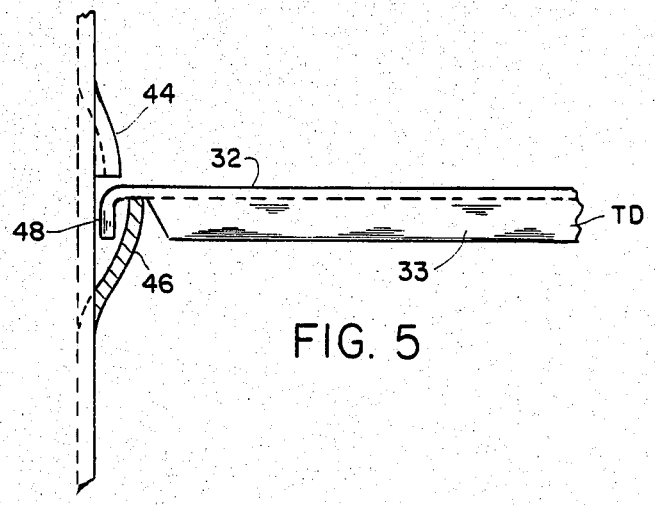
FIG. 5 is a front elevational view partially in section of the interior of the box, showing the bracket means of FIG. 4 disposed in engaging relation to the shelf.

The partitions or shelf members 32 are supported at their transversely spaced, opposing longitudinal edges by the bracket members generally designated 42 shown in FIG. 4 and 4A. The bracket assembly 42, only half of which is shown in FIG. 4, includes an upper bracket 44 and a lower bracket 46. The arrangement shown in FIG. 4 represents the left half of the bracket assembly, there being a similar assembly on the right side of the interior of each box 12. The manner in which the brackets 44 and 46 support and interlock the shelf members 32 is best seen in FIG. 5. It will there be seen that each shelf member 32 has a downwardly turned portion 48 that interlocks with the bracket member 46 as shown. Bracket 44 overhangs the edge of shelf 32, as is clearly shown, to prevent lifting of such shelf 32. Although not shown in FIG. 5, it should be understood that sliding retraction of shelf 32 from the bracket assembly 42 is prevented by the presence of hinge members 26 (and/or the door 12 immediately above and below, as aforesaid) that are shown in FIG. 2.

As can be clearly seen in FIG. 5, the partition 32 includes a front angularly turned portion 33 defining a thickness dimension TD of the partition 32. As it should be apparent from FIG. 2, the thickness dimension TD of the partition 32 is greater than the spaced distance SD between adjacent doors 12. Accordingly, both of the adjacent doors, for example, 12' and 12A must be opened to permit removal of shelf 32A.

Figure 7A:
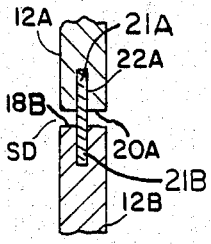
FIGS. 7A–7D are section views of the box doors, showing differing transverse cross sectional views of the strip member shown in FIG. 6.
Figure 7B:
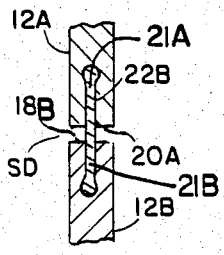
Figure 7C:
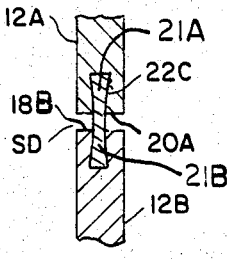
Figure 7D:
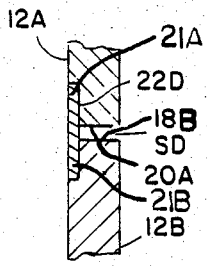

FIGS. 7A–7C illustrate various cross-sectional views of adjacent doors 12A and 12B with different interlocking means. FIGS. 7A–7C illustrate the interlocking means being disposed in the central region of edges 20A and 18B whereas FIG. 7D incorporates a groove means on a side wall of the doors 12A and 12B.

Figure 6:
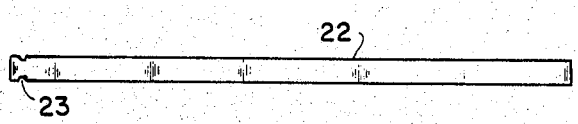
FIG. 6 is a side elevational view of an elongate strip member that interlocks vertically adjacent box doors.
Figure 6B:
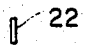
FIG. 6B is a right side elevational view of FIG. 6.
Figure 6A:
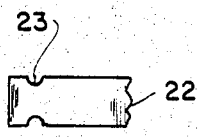
FIG. 6A shows an alternative embodiment of the strip member shown in FIG. 6.
Figure 8:
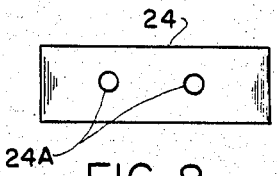
FIG. 8 is a front elevational view of the ganging plate member that provides rigidity to interlocked adjacent door members.
Figure 9:
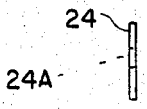
FIG. 9 is a side elevational view of the plate member shown in FIG. 8.

FIG. 6 shows the strip member 22, disclosed hereinabove, and the cut away portion 23 that was mentioned earlier. In FIG. 6A, an alternative embodiment of the notch 23 is shown. In either embodiment, of course, the purpose of the cut away portion of 23 is to provide clearance for hinge fasteners 28, as mentioned earlier.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. An array of lockable containers, comprising in combination: container means;

a first and a second door each having a first and a second edge;

a first and a second hinge member secured relative to said container means and each having a pivotal axis along a common line;

said first and second hinge members pivotably mounting said first and second doors between an open position and a closed position with said second edge of said first door being adjacent said first edge of said second door and for providing a spaced distance between said second edge of said first door and said first edge of said second door when said first and second doors are in said closed position;

a first, second and a third partition each having a thickness dimension which is greater than said spaced distance between said first and second doors;

means for mounting said first partition adjacent said first edge of said first door and for mounting said second partition adjacent said spaced distance between said first and second doors for defining a first container in said container means between said first and second partitions;

means for mounting said third partition adjacent said second edge of said second door for defining a second container in said container means between said second and third partitions;

said first and second doors inhibiting removal of said second partition when either of said first and second doors are in said closed position and for permitting removal of said second partition only when both of said first and second doors are in said open position; and elongated interlocking means for interlocking said first and second doors for movement in unison and for covering said spaced distance between said first and second doors enabling said first and second containers to be converted into a single container defined by said first and said third partitions upon removal of said second partition.

2. An array as set forth in claim 1, wherein said first and second doors include first and second groove means, respectively;

said elongated interlocking means being receivable in said first and second groove means for interlocking said first and second doors to one another.

3. An array as set forth in claim 2, wherein said first and second groove means are disposed in the central region of an edge of said first and second doors, respectively.

4. An array as set forth in claim 2, wherein said first and second groove means are disposed in a side surface of said first and second doors, respectively.

5. An array as set forth in claim 1, including means for locking said first and second doors in said closed position.

6. An array as set forth in claim 1, wherein each of said partitions includes a shelf portion and a front angularly turned portion; and said front angularly turned portion defining said thickness dimension which is greater than said spaced distance between said first and second doors.

7. An array as set forth in claim 1, wherein said first and second hinges are secured to said container means by fastening means; and said elongated interlocking means having cut out means for receiving said fastening means for preventing movement of said elongated interlocking means relative to said first and second doors.

8. An array as set forth in claim 1, including a ganging member for complementing said elongated interlocking means for securing said first door to said second door.

9. An array as set forth in claim 1, wherein said means for mounting said partitions include bracket means disposed on the sidewalls of said container means.

10. An array of lockable containers, comprising in combination: container means a first and a second door each having a first and a second edge;

said first and second doors including first and second groove means respectively;

a first and a second hinge secured relative to said container means and each having a pivotal axis along a common line;

said first and second hinges pivotably mounting said first and second doors between an open position and a closed position with said second edge of said first door being adjacent said first edge of said second door and for providing a spaced distance between said second edge of said first door and said first edge of said second door when said first and second doors are in said closed position;

means for locking said first and second doors in said closed position;

a first, second and a third partition each having a thickness dimension which is greater than said spaced distance between said first and second doors;

means for mounting said first partition adjacent said first edge of said first door and for mounting said second partition adjacent said spaced distance between said first and second doors for defining a first container in said container means between said first and second partitions;

means for mounting said third partition adjacent said second edge of said second door for defining a second container in said container means between said second and third partitions;

said means for mounting said partitions including bracket means disposed on the sidewalls of said container means;

said first and second doors inhibiting removal of said second partition when either of said first and second doors are in said closed position and for permitting removal of said second partition only when both of said first and second doors are in said open position; and elongated interlocking means being receivable in said first and second groove means for interlocking said first and second doors to one another for movement in unison and for covering said spaced distance between said first and second doors enabling said first and second containers to be converted into a single container defined by said first and said third partitions upon removal of said second partition.

11. An array of lockable containers, comprising in combination:

container means;

a first, second and a third door each having a first and a second edge;

a first, second, and a third hinge secured relative to said container means and each having a pivotal axis along a common line;

said first, second and third hinges pivotably mounting said first, second and third doors between an open position and a closed position with said second edge of said first door being adjacent said first edge of said second door with a first spaced distance between said second edge of said first door and said first edge of said second door and with said second edge of said second door being adjacent said first edge of said third door with a second spaced distance between said second edge of said second door and said first edge of said third door when said first, second and third doors are in said closed position;

means for locking said first, second and third doors in said closed position;

a first, second, third and fourth partition each having a thickness dimension which is greater than each of said first and second spaced distances;

means for mounting said first partition adjacent said first edge of said first door and for mounting said second partition adjacent said first spaced distance between said first and second doors for defining a first container in said container means between said first and second partitions;

means for mounting said third partition adjacent said second spaced distance between said second and third doors for defining a second container in said container means between said second and third partitions;

means for mounting said fourth partition adjacent said second edge of said third door for defining a third container in said container means between said third and fourth partitions;

said first and second doors inhibiting removal of said second partition when either of said first and second doors is in said closed position and for permitting removal of said second partition only when both of said first and second doors are in said open position;

said second and third doors inhibiting removal of said third partition when either of said second and third doors is in said closed position and for permitting removal of said third partition only when second and third doors are in said open position;

first elongated interlocking means for interlocking said first and second doors to one another for movement in unison and for covering said first spaced distance between said first and second doors enabling said first and second containers to be converted into a container defined by said first and said third partitions upon removal of said second partition; and elongated interlocking means for interlocking said second and third doors to one another for movement in unison and for covering said second spaced distance between said second and third doors enabling said third container to be converted into a container defined by said first and said fourth partitions upon removal of said third partition.

* * * * *

UNITED STATES PATENT AND TRADEMARK OFFICE

CERTIFICATE OF CORRECTION

PATENT NO. : 4,528,916

DATED : July 16, 1985

INVENTOR(S) : Lloyd F. Knight

It is certified that error appears in the above-identified patent and that said Letters Patent are hereby corrected as shown below:

Title page, Assignee: Delete "Safe Deposit Box Construction" and insert --National Safe Corporation--.

Column 1, after line 47, insert the following paragraphs:

--Therefore, it is a primary object of this invention to provide a safe deposit box construction of modular, or non-monolithic construction so that a single installation of safe deposit boxes provides any desired mix of box size.

Another object of this invention is to reduce the overhead associated with vault maintaining institutions by reducing the number of unrented or uneconomically rented safe deposit boxes.

Another object of this invention is to provide a modular safe deposit box installation whereby the pattern of box sizes throughout the installation may be readily changed by authorized personnel having a minimal degree of mechanical skill.

Another object of this invention is to provide an installation where the unauthorized changing of box sizes is prevented.

The invention accordingly comprises the features of construction, combination of elements and arrangements of parts that will be exemplified in the construction hereinafter set forth, and the scope of the invention will be indicated in the claims.

Signed and Sealed this

Thirtieth Day of December, 1986

*Attest:*

DONALD J. QUIGG

*Attesting Officer* *Commissioner of Patents and Trademarks*